US007821478B2

(12) United States Patent
Tsuchida

(10) Patent No.: US 7,821,478 B2
(45) Date of Patent: Oct. 26, 2010

(54) DISPLAY APPARATUS AND METHOD OF DRIVING SAME

(75) Inventor: Masami Tsuchida, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 1306 days.

(21) Appl. No.: 11/341,562

(22) Filed: Jan. 30, 2006

(65) Prior Publication Data

US 2006/0187154 A1 Aug. 24, 2006

(30) Foreign Application Priority Data

Jan. 31, 2005 (JP) ..... 2005-023547

(51) Int. Cl.
*G09G 3/30* (2006.01)

(52) U.S. Cl. ..... 345/76; 345/77; 345/78

(58) Field of Classification Search ..... 345/76–79, 345/82, 690; 315/169.1–169.4
See application file for complete search history.

(56) References Cited

U.S. PATENT DOCUMENTS 6,229,506 B1 5/2001 Dawson et al.
6,587,087 B1 * 7/2003 Ishizuka ..... 345/82
2003/0112208 A1 6/2003 Okabe et al.
2004/0252085 A1 * 12/2004 Miyagawa ..... 345/76
2005/0083270 A1 * 4/2005 Miyazawa ..... 345/76

OTHER PUBLICATIONS

S. J. Zilker, et al., "Bias Stress in Organic Thin-Film Transistors and Logic Gates", The American Institute of Physics, vol. 79, No. 8 Aug. 2001, pp. 1124-1126.

* cited by examiner

*Primary Examiner*—Regina Liang
(74) *Attorney, Agent, or Firm*—Sughrue Mion, PLLC

(57) ABSTRACT

Disclosed is a display apparatus which can improve the characteristics of TFTs used to select and drive self-emissive elements such as OLEDs. The display apparatus has row electrodes, column electrodes, and a driving unit. The self-emissive elements are formed in regions corresponding to intersections of the row electrodes with the column electrodes. Element driving circuits are formed for driving the self-emissive elements. Each of the element driving circuits includes a selection transistor, a capacitor, and a driving transistor. The driving unit applies a reverse bias to a control terminal of the driving transistor in a non-emission period in which the self-emissive element is not supplied with a driving current.

25 Claims, 8 Drawing Sheets

DISPLAY APPARATUS AND METHOD OF DRIVING SAME

BACKGROUND OF THE INVENTION

1. Field of the Invention

The present invention relates to a display apparatus which includes an active element for driving a self-emissive element such as an organic EL (ElectroLuminescent) element, LED (light emitting diode) or the like, and method of driving the same, and more particularly to a display apparatus which includes a TFT (thin film transistor) using an organic semiconductor as the active element.

2. Description of the Related Art

The TFT is widely used as an active element for driving an active matrix type display such as an organic EL display or a liquid crystal display. FIG. 1 depicts a diagram showing an example of an equivalent circuit for driving, for example, an OLED (Organic Light Emitting diode) 100 which is an organic EL element. Referring to FIG. 1, this equivalent circuit includes a capacitor $C_S$, and two p-channel TFTs 101, 102 which are active elements. A scanning line $W_S$ is connected to a gate of the selection TFT 101, a data line $W_D$ is connected to a source of the selection TFT 101, and a power supply line $W_K$ for supplying a constant supply voltage $V_{DD}$ is connected to a source of the driving TFT 102. The selection TFT 101 has a drain connected to a gate of the driving TFT 102, and a capacitor $C_S$ is formed between the gate and the source of the driving TFT 102. The OLED has an anode connected to a drain of the driving TFT 102, and a cathode connected to a common potential, respectively.

As a selection pulse is applied to the scanning line $W_S$, the selection TFT as a switch turns on and therefore has a conducting channel between the source and the drain. At this time, a data voltage is supplied from the data line $W_D$ through the source and drain of the selection TFT 101, and charges are accumulated to create the data voltage on the capacitor $C_S$. The data voltage created on the capacitor $C_S$ is applied between the gate and source of the driving TFT 102, thus causing a drain current $I_D$ to flow in accordance with a gate-source voltage (hereinafter referred to as the "gate voltage") Vgs of the driving TFT 102. The drain current $I_D$ is supplied to the OLED 100. However, a threshold voltage of the driving TFT 102 shifts as the driving time passes. An example of the relationship between the gate voltage Vgs of the TFT and the drain current $I_d$ is shown in FIG. 2. As shown in FIG. 2, there can be found a phenomenon that a curve 120A in an initial state shifts to a curve 120B as the driving time passes, and that the gate threshold voltage shifts from Vth1 to Vth2. Such a threshold voltage shift causes problems of giving rise to a reduction in luminance of light emitted by the OLED, and making the TFT inoperative.

Single crystal silicon, amorphous silicon, polycrystalline silicon, or low-temperature polycrystalline silicon is widely used for an active layer which forms part of the TFT. In recent years, attention has been paid to a TFT which uses an organic material that is based on carbon and hydrogen as an active layer (hereinafter referred to as the "organic TFT"), instead of those silicon materials. FIG. 3 depicts a schematic diagram showing a cross section of a typical organic TFT. This organic TFT includes a plastic substrate 111, a gate electrode 112, an insulating film 113, a drain electrode 114, a source electrode 115, and an organic semiconductor layer 116. The gate electrode 112 is formed on the plastic substrate 111, and the insulating film 113 is formed to cover the gate electrode 112. On this insulating film 113, the drain electrode 114 and the source electrode 114 are deposited so as to oppose each other, and the organic semiconductor layer (i.e., active layer) 116 is formed between the drain electrode 114 and the source electrode 115. Materials used for the organic semiconductor layer 116 include low-molecular-weight based or polymer based organic materials having a relatively high carrier mobility, such as pentacene, naphthacene, or polythiophen-based materials. This type of organic TFT can be formed on a flexible film such as a plastic film in a relatively low-temperature process, and therefore enables a mechanically flexible, light weight, and thin display to be readily manufactured. Also, the organic TFT can be formed by a printing process, or a roll-to-roll process at a relatively low cost. The aforementioned threshold voltage shifting phenomenon appears conspicuously in the amorphous silicon TFT and organic TFT. The threshold voltage shift of the organic TFT is disclosed, for example, in the following article: S. J. Ziler, C. Detcheverry, E. Cantatore, and D. M. de Leeuw, "Bias stress in organic thin-film transistors and logic gates," Applied Physics Letters Vol. 79(8), pp. 1124-1126, Aug. 20, 2001.

Driving circuits and driving methods which can compensate for a threshold voltage shift of the TFT are disclosed, for example, in Japanese Patent Application Kokai No. 2002-514320 (corresponding to U.S. Pat. No. 6,229,506), and Japanese Patent Application Kokai No. 2002-351401 (corresponding to U.S. Patent Application Publication No. 2003112208). Either of the driving circuits and driving methods described in these documents can control the OLED to emit light at a constant luminance, while accepting the threshold voltage shift of the driving TFT. However, since the driving circuits of these documents cannot either eliminate the threshold voltage shift, they cannot prevent an increase in power consumption due to the threshold voltage shift. Also, if the threshold voltage of the driving TFT shifts beyond an allowable range, it is difficult to compensate for the shift, resulting in variations in the luminance of light emitted by the OLEDs, and in inoperative TFTs. Further, since the threshold voltage shift occurs in the selection TFT as well, other than the driving TFT, the selection TFT will be made inoperative if the threshold voltage of the selection TFT shifts beyond the allowable range. Particularly, the threshold voltage shift of the organic TFT is large as compared with those of the low-temperature polysilicon TFT and single crystal silicon TFT, so that an active matrix type display which uses the organic TFT has a problem of higher susceptibility to variations in the luminance of light emitted by the OLEDs, and inoperative TFTs.

SUMMARY OF THE INVENTION

In view of the foregoing, it is an object of the present invention to provide a display apparatus which is capable of improving the characteristics of transistors used to select and drive self-emissive elements such as the OLEDs, particularly, the characteristics of organic transistors which use an organic semiconductor in an active layer based upon an active matrix driving scheme, and a method of driving the same.

According to a first aspect of the present invention, there is provided a display apparatus. This display apparatus comprises row electrodes, column electrodes intersecting the row electrodes, a driving unit for supplying a scanning signal to the row electrodes and supplying data signals to the column electrodes, self-emissive elements respectively formed in regions corresponding to respective intersections of the row electrodes with the column electrodes, and element driving circuits respectively formed in regions corresponding to the respective intersections for driving the self-emissive elements in accordance with the scanning signal and the data signals. Each of the element driving circuits includes: at least one selection transistor having a control terminal connected to the row electrode and having a first and a second controlled terminal, the at least one selection transistor having a conducting channel between the first and second controlled terminals in response to a forward bias applied to the control terminal on receiving the scanning signal; a capacitor for accumulating charges which creates a voltage corresponding to the data signal supplied from the driving unit through the first and second controlled terminals of the selection transistor in a period in which the selection transistor has a conducting channel between the first and second controlled terminals; and a driving transistor having a control terminal connected to one end of the capacitor, and a first and a second controlled terminal, one of the first and second controlled terminals being connected to the self-emissive element, and the driving transistor supplying the self-emissive element with an amount of driving current depending on a forward bias which is applied to the control terminal in response to the voltage created on the capacitor. The driving unit applies a reverse bias to the control terminal of the driving transistor in a non-emission period in which the driving current is not applied to the self-emissive element.

According to a second aspect of the present invention, there is provided a display apparatus. This display apparatus comprises row electrodes, column electrodes intersecting the row electrodes, a driving unit for supplying a scanning signal to the row electrodes and supplying data signals to the column electrodes, self-emissive elements respectively formed in regions corresponding to respective intersections of the row electrodes with the column electrodes, and element driving circuits formed in regions corresponding to the respective intersections for driving the self-emissive elements in accordance with the scanning signal and the data signals. Each of the element driving circuits includes: at least one selection transistor having a control terminal connected to the row electrode and having a first and a second controlled terminal, the at least one selection transistor having a conducting channel between the first and second controlled terminals in response to a forward bias applied to the control terminal on receiving the scanning signal; a capacitor for accumulating charges which creates a voltage corresponding to the data signal supplied from the driving unit through the first and second controlled terminals of the selection transistor in a period in which the selection transistor has a conducting channel between the first and second controlled terminals; and a driving transistor having a control terminal connected to one end of the capacitor, and a first and a second controlled terminal, one of the first and second controlled terminals being connected to the self-emissive element, and the driving transistor supplying the self-emissive element with an amount of driving current depending on a forward bias which is applied to the control terminal in response to the voltage created on the capacitor. The driving unit applies a reverse bias to the control terminal of the selection transistor in an emission period in which the driving current is applied to the self-emissive element.

According to a third aspect of the present invention there is provided a driving method for a display apparatus. This driving method is a method for a display apparatus including row electrodes, column electrodes intersecting the row electrodes, a driving unit for supplying a scanning signal to the row electrodes and supplying data signals to the column electrodes, self-emissive elements respectively formed in regions corresponding to intersections of the row electrodes with the column electrodes, and element driving circuits formed in regions corresponding to the respective intersections for driving the self-emissive elements in accordance with the scanning signal and the data signals. Each of the element driving circuits includes: at least one selection transistor having a control terminal connected to the row electrode, and a first and a second controlled terminal; a capacitor; and a driving transistor having a control terminal connected to one end of the capacitor and having a first and a second controlled terminal, one of the first and second controlled terminals being connected to the self-emissive element. The driving method comprises the steps of: (a) supplying the selection transistor with a scanning signal to apply a forward bias to the control terminal of the selection transistor to form a conducting channel between the first and second controlled terminals of the selection transistor; (b) supplying a data signal to the capacitor through the first and second controlled terminals of the selection transistor in a period in which the selection transistor has a conducting channel between the first and second controlled terminals, to accumulate charges which creates a voltage corresponding to the data signal on the capacitor; (c) supplying the self-emissive element with an amount of driving current depending on a forward bias which is applied to the control terminal of the driving transistor in response to the voltage created on the capacitor; and (d) applying a reverse bias to the control terminal of the driving transistor in a non-emission period in which the self-emissive element is not supplied with the driving current.

According to a fourth aspect of the present invention, there is provided a driving method for a display apparatus. This driving method is a method for a display apparatus including row electrodes, column electrodes intersecting the row electrodes, a driving unit for supplying a scanning signal to the row electrodes and supplying data signals to the column electrodes, self-emissive elements respectively formed in regions corresponding to intersections of the row electrodes with the column electrodes, and element driving circuits formed in regions corresponding to the respective intersections for driving the self-emissive elements in accordance with the scanning signal and the data signals. Each of the element driving circuits includes: at least one selection transistor having a control terminal connected to the row electrode, and a first and a second controlled terminal; a capacitor; and a driving transistor having a control terminal connected to one end of the capacitor and having a first and a second controlled terminal, one of the first and second controlled terminals being connected to the self-emissive element. The driving method comprises the steps of: (a) supplying the selection transistor with a scanning signal to apply a forward bias to the control terminal of the selection transistor to form a conducting channel between the first and second controlled terminals of the selection transistor; (b) supplying a data signal to the capacitor through the first and second controlled terminals of the selection transistor in a period in which the selection transistor has a conducting channel between the first and second controlled terminals, to accumulate charges which creates a voltage corresponding to the data signal on the capacitor; (c) supplying the self-emissive element with an amount of driving current depending on a forward bias which is applied to the control terminal of the driving transistor in response to the voltage created on the capacitor; and (d) applying a reverse bias to the control terminal of the selection transistor in an emission period in which the self-emissive element is supplied with the driving current.

Further features of the invention, its nature and various advantages will be more apparent from the accompanying drawings and the following detailed description of the preferred embodiments.

DETAILED DESCRIPTION OF THE INVENTION

Various embodiments according to the present invention will be described below.

Figure 1:
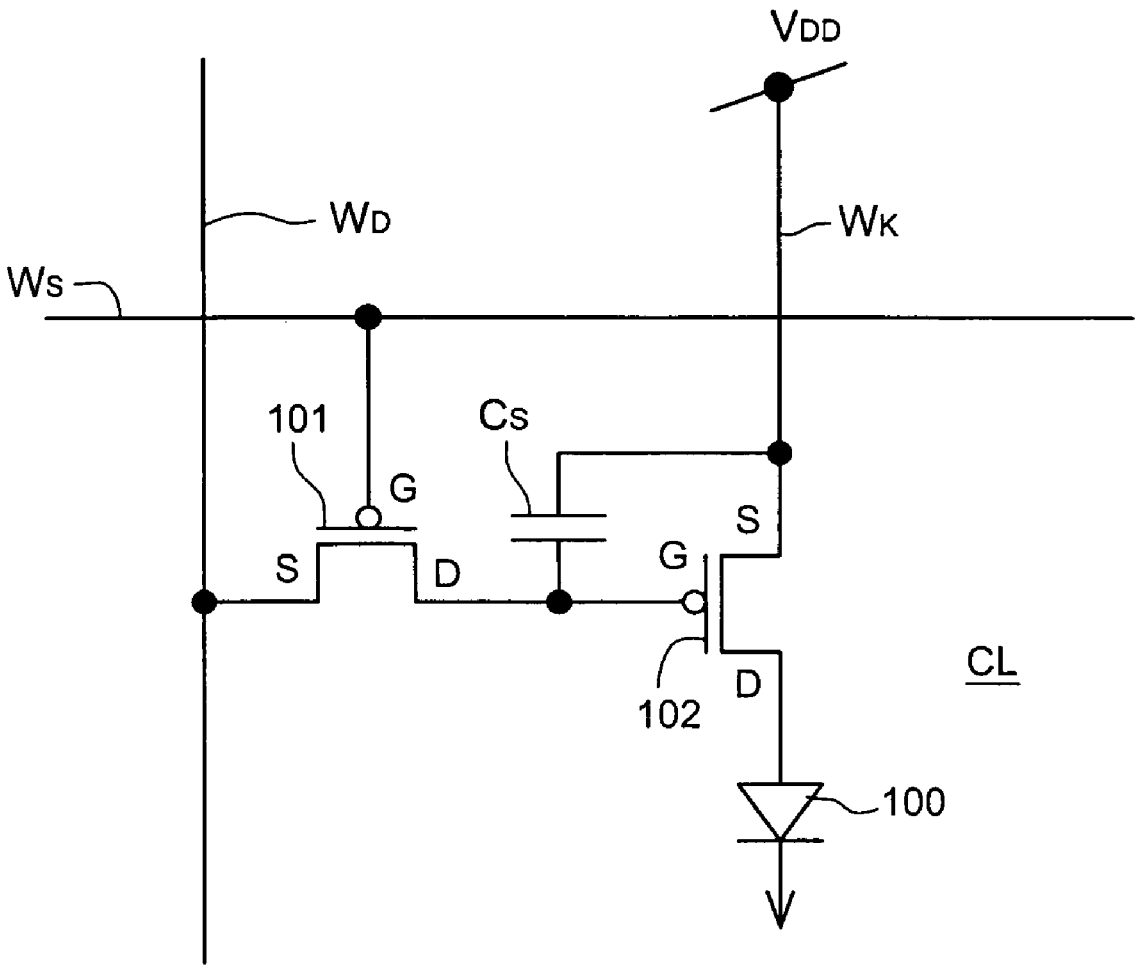
FIG. 1 PRIOR ART
FIG. 1 depicts a diagram showing an example of an equivalent circuit for driving an OLED.
Figure 2:
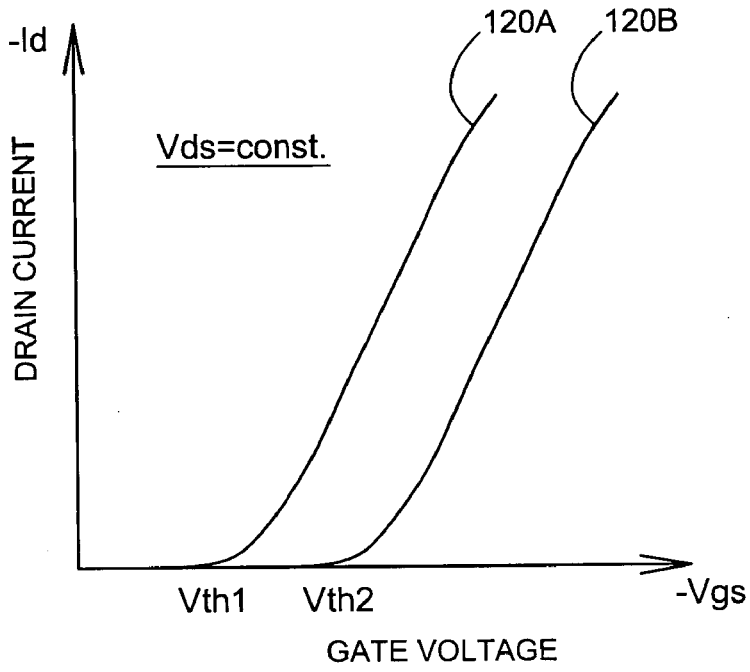
FIG. 2 PRIOR ART
FIG. 2 is a graph showing the relationship between a gate voltage and a drain current.
Figure 3:
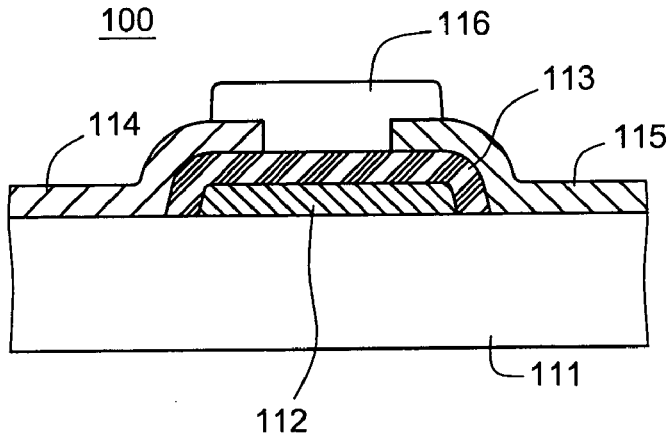
FIG. 3 PRIOR ART
FIG. 3 depicts a schematic diagram showing a cross section of a typical organic TFT.
Figure 4:
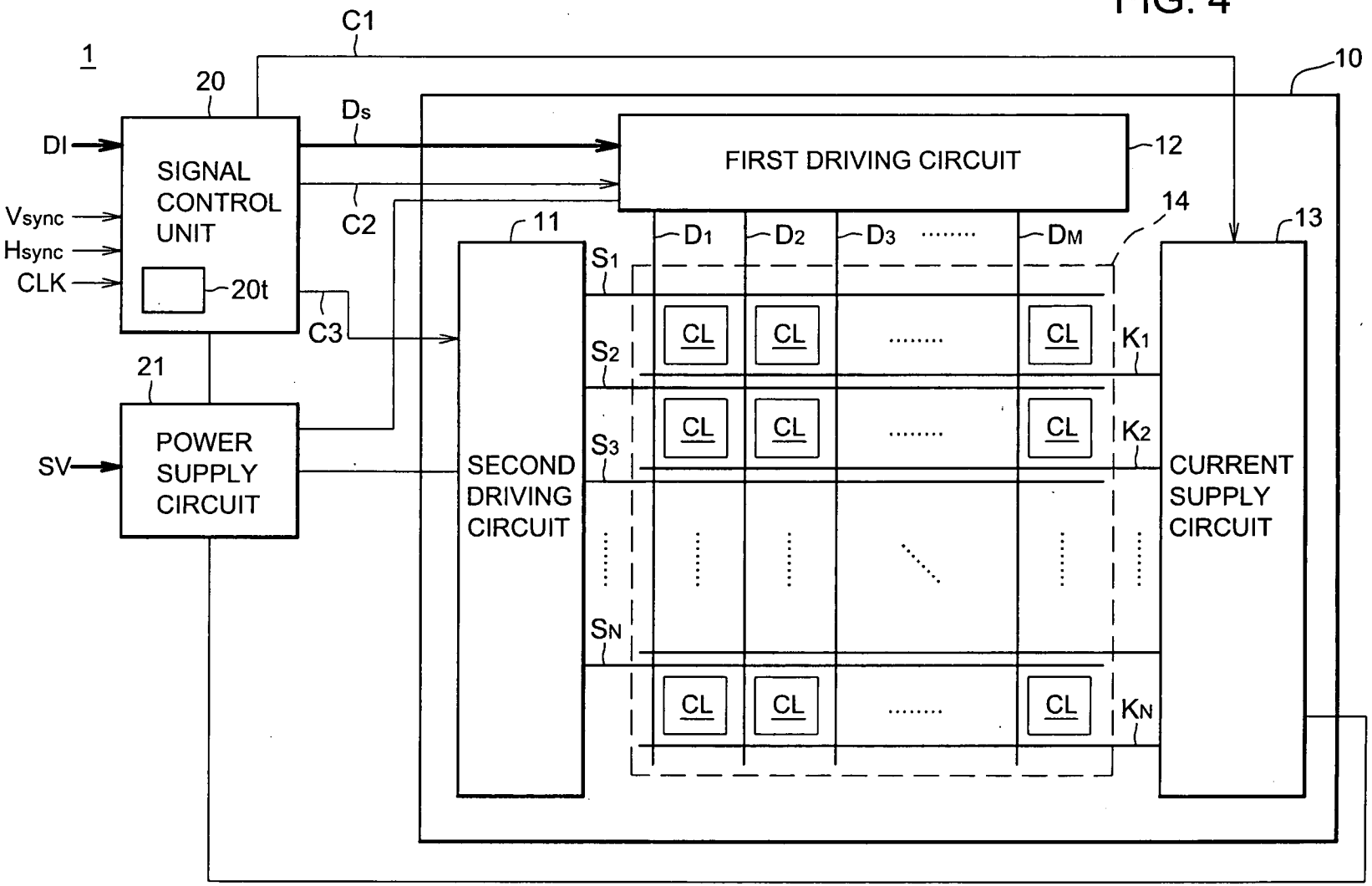
FIG. 4 depicts a block diagram schematically showing a display apparatus of an embodiment according to the present invention.

FIG. 4 depicts a block diagram schematically showing a display apparatus 1 of an embodiment according to the present invention. This display apparatus 1 comprises a substrate 10, a second driving circuit 11, a first driving circuit 12, a current supply circuit (third driving circuit) 13, a signal control unit 20, and a power supply circuit 21. A driving unit of the present invention can be made up of the second driving circuit 11, first driving circuit 12, current supply circuit 13, and signal control unit 20. The power supply circuit 21 generates supply voltages to be applied to the signal controller 20, second driving circuit 11, first driving circuit 12, and current supply circuit 13, respectively, based on external power SV supplied from an external power supply (not shown).

A glass substrate or a plastic substrate can be used as the substrate 10. Materials for the plastic substrate may include, for example, acrylic-based resin such as PMMA (poly ethyl methacrylate), PC (polycarbonate), PBT (polybutylene terephthalate), PTE (polyethylene terephthalate), PPS (polyphenylene sulfide), or PEEK (polyether ether ketone).

On the substrate 10 there are formed a display unit 14 comprising a plurality of display cells CL, the second driving circuit 11, the first driving circuit 12, and the current supply circuit 13. Each of these display cells CL may constitute one pixel. Alternatively a plurality of display cells CL may constitute one pixel for color display or area halftone. For example, three display cells CL which constitute one pixel for color display, can have R (red), G (green), and B (blue) color filters, respectively. Alternatively a 2-bit area halftone can be realized by a combination of emissions or no-emissions of the three display cells which constitute one pixel.

On the substrate 10 there are further formed N scanning lines (i.e., a group of row electrodes) $S_1, \ldots, S_N$ (N is an integer equal to or larger than two) extending in the horizontal direction; M data lines (a group of column electrodes) $D_1, \ldots, D_M$ (M is an integer equal to or larger than two) extending in the vertical direction; and N power supply lines (a group of power supply electrodes) $K_1, \ldots, K_N$ extending in the horizontal direction. The scanning lines (or selection electrodes) $S_1, \ldots, S_N$ are connected to the second driving circuit 11, the data lines $D_1, \ldots, D_M$ are connected to the first driving circuit 12, and the power supply liens $K_1, \ldots, K_N$ are connected to the current supply circuit 13. M×N display cells CL are formed in regions corresponding to respective intersections of the scanning lines $S_1, \ldots, S_N$ with the data lines $D_1, \ldots, D_M$, respectively.

The signal control unit 20 is supplied with a video signal DI, a vertical synchronizing signal Vsync, a horizontal synchronizing signal Hsync, and a system clock CLK. The signal control unit 20 samples the video signal DI using the synchronizing signals Vsync, Hsync and the system clock CLK, and processes the sampled video signal DI to generate a digital image signal $D_S$ of L-bit halftone (L is an integer equal to or larger than two). The signal control unit 20 also generates control signals C1, C2, C3, indicative of operation timings, which are supplied to the second driving circuit 11, first driving circuit 12, and current supply circuit 13, respectively.

The first driving circuit 12 includes a shift register, a latch circuit, and an output circuit (none of which is shown). The shift register sequentially samples the image signal $D_S$ supplied from the signal control unit 20 in synchronization with a clock included in the control signal C2. The latch circuit fetches the sampled signals for one horizontal line from the shift register. The output circuit converts the signals fetched by the latch circuit into data signals. These data signals are supplied to the data lines $D_1, \ldots, D_M$, respectively. Further, in addition to a circuit group for generating and supplying the data signals to the data lines $D_1, \ldots, D_M$, the first driving circuit 12 includes a correction circuit that supplies a signal having the opposite polarity of the signal level to that of the data signal, for example, a circuit that supplies a correction signal having a negative signal level when the data signal has a positive signal level.

The second driving circuit 11 sequentially applies a scanning signal to the scanning lines $S_1, \ldots, S_N$ every frame display period when an image is displayed in accordance with a progressive scanning scheme. When an image is displayed in accordance with an interlace scanning scheme, the second driving circuit 11 sequentially applies the scanning signal to the scanning lines on even-numbered lines or odd-numbered lines every field display period, in order to alternately display first and second fields, the first field containing signals of even-numbered lines of each frame, and the second field containing signals of odd-numbered lines of each frame. The first driving circuit 12 supplies a data signal to a display cell CL selected by the scanning signal through a data line $D_Q$ (Q is one of 1 to M). Further, in addition to a circuit group for generating and supplying the scanning signal to the scanning lines $S_1, \ldots, S_N$, the second driving circuit 11 includes a circuit for supplying a signal having the opposite polarity of the signal level to that of the scanning signal, for example, a circuit for supplying a correction signal having a positive signal level when the scanning signal has a negative signal level.

Figure 5:
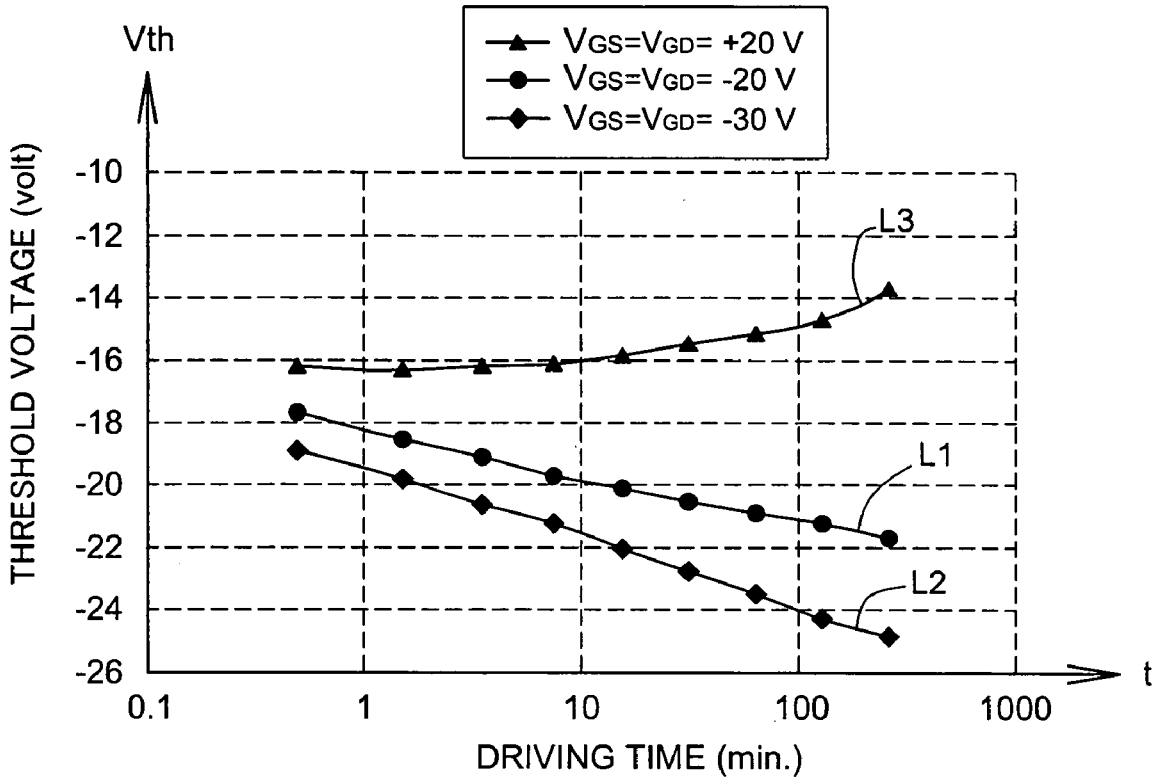
FIG. 5 is a graph illustrating a threshold voltage shift of a p-channel organic TFT.

Each of the display cells CL has a self-emissive element, at least one selection TFT, at least one driving TFT, and a capacitor. The selection TFT, driving TFT, and capacitor constitute an element driving circuit for driving the self-emissive element. In this embodiment, the OLED which is an organic EL element, for example, is used as the self-emissive element, and organic TFTs are used as the selection TFT and driving TFT. FIG. 5 is a graph illustrating a threshold voltage shift of a p-channel organic TFT. The vertical axis of the graph represents a gate threshold voltage Vth (in volts) in a linear scale, and the horizontal axis represents a driving time (in minutes) in a logarithmic scale. The threshold voltage Vth was measured under the conditions that the gate and source of the organic TFT are connected to ground and that a gate voltage $V_{GS}$ of −20 volts, −30 volts, and +20 volts are separately applied. Measurement curves L1, L2 are curves when a forward bias is at −20 volts and −30 volts, respectively, and a measurement curve L3 is a curve when a reverse bias is at +20 volts. As shown in FIG. 5, as the gate is continuously applied with a forward bias, the threshold voltage Vth shifts in the negative direction, whereas as the gate is continuously applied with a reverse bias, the threshold voltage Vth shifts in the positive direction. Therefore, when the application of the forward bias causes a threshold voltage shift in the TFT, a reverse bias may be applied to the gate of the TFT to correct the threshold voltage shift.

Figure 6:
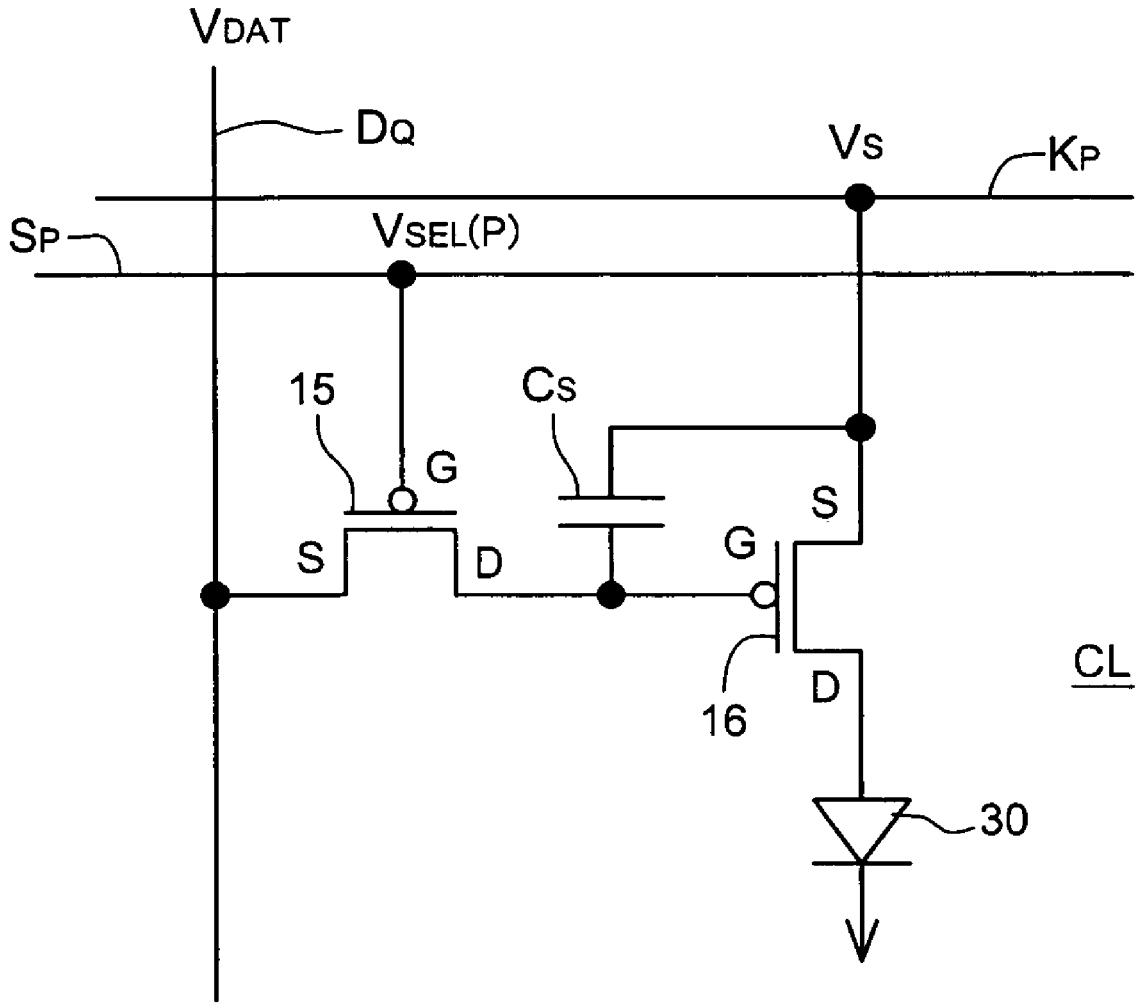
FIG. 6 depicts a diagram showing an example of an equivalent circuit of a display cell.

The driving method of this embodiment applies a reverse bias to the gate of each of the selection TFT and driving TFT in order to correct a threshold voltage shift caused by the application of a forward bias to the gate of each of the selection TFT and driving TFT during a frame display period or a field display period. In the following, the driving method of this embodiment will be described with reference to FIGS. 6 and 7. FIG. 6 depicts a diagram showing an example of an equivalent circuit of the display cell CL, and FIG. 7 is a timing chart schematically showing the waveforms of signals applied to the equivalent circuit shown in FIG. 6.

Referring to FIG. 6, the display cell CL includes a p-channel selection TFT 15, a p-channel driving TFT 16, a capacitor $C_S$, and an OLED 30. A scanning line $S_P$ (P is one of 1 to N) is connected to a gate (control terminal) of the selection TFT 15, a data line $D_Q$ (Q is one of 1 to M) is connected to a source (controlled terminal) of the selection TFT 15, and a power supply line $K_P$ is connected to a source (controlled terminal) of the driving TFT 16. The capacitor $C_S$ has one terminal connected to the gate of the driving TFT 16, and the other terminal connected to the source of the driving TFT 16. The OLED 30 has an anode connected to the drain (controlled terminal) of the driving TFT 16, and a cathode applied with a common potential.

Figure 7:
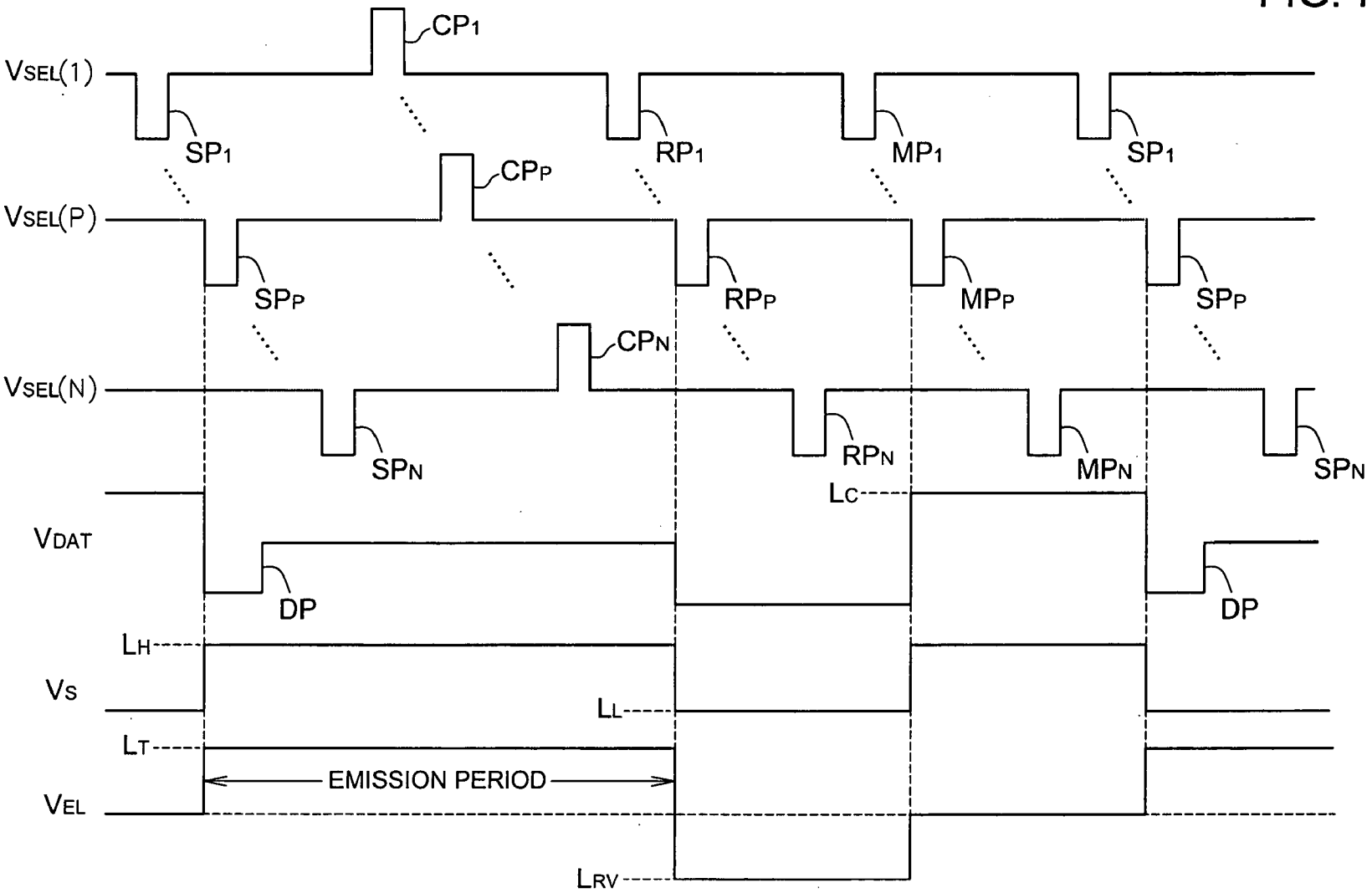
FIG. 7 is a timing chart schematically showing waveforms of signals applied to the equivalent circuit shown in FIG. 6.

Referring to FIG. 7, $V_{SEL}(1), \ldots, V_{SEL}(P), \ldots, V_{SEL}(N)$ represent voltages applied to the scanning lines $S_1, \ldots, S_P, \ldots, S_N$, respectively; $V_{DAT}$ represents a voltage applied to the data line $D_Q$ which passes through the equivalent circuit shown in FIG. 6; $V_S$ represents a voltage applied to the power supply line $K_P$ which passes through the equivalent circuit; and $V_{EL}$ represents a voltage applied to the OLED 30 of the equivalent circuit.

First, in a data write period, the second driving circuit 11 sequentially supplies negative selection pulses $SP_1, \ldots, SP_N$ to the scanning lines $S_1, \ldots, S_N$, respectively. Consequently, the display cells CL are sequentially selected, and the selected display cell CL is supplied with the selection pulse $SP_P$ (P is one of 1 to N). As a result, since the voltage (forward bias) of the selection pulse $SP_P$ is applied to the gate of the selection TFT 15, the selection TFT 15 turns on and therefore has a conducting channel between the source and the drain. However, the forward bias is applied to the gate of the selection TFT 15, causing the threshold voltage shift of the selection TFT 15.

The first driving circuit 12 supplies a negative data pulse DP to the data line $D_Q$ in a period in which the selection voltage $V_{SEL}(P)$ is applied to the gate of the selection TFT 15. The data pulse DP reaches the capacitor $C_S$ through the source and drain of the selection TFT 15, resulting in creation of a data voltage on the capacitor $C_S$.

The current supply circuit 13 continuously supplies a positive supply voltage $V_S$ having a high level $L_H$ to the source of the driving TFT 16 through the power supply line $G_P$ during the data write period. Thus, the driving TFT 16 supplies the OLED 30 with an amount of drain current Id depending on the data voltage applied between the gate and source thereof to apply a forward bias $L_T$ to the OLED 30, thus causing the OLED 30 to emit light.

Subsequently, in a first correction period for TFT characteristic, the second driving circuit 11 sequentially supplies positive correction pulses $CP_1, \ldots, CP_N$ to the scanning lines $S_1, \ldots, S_N$, respectively. In this way, since the voltage (reverse bias) of the correction pulse $CP_1, \ldots, CP_N$ is applied to the gate of the selection TFT 15, the threshold voltage shift, which has occurred during the data write period, is corrected. However, since the forward bias is continuously applied to the gate of the driving TFT 16 during the data write period and first correction period for TFT characteristic, the threshold voltage of the driving TFT 16 shifts.

Subsequently, in a correction period for EL characteristic, the second driving circuit 11 sequentially supplies negative selection pulses $RP_1, \ldots, RP_N$ to the scanning lines $S_1, \ldots, S_N$, respectively, while the first driving circuit 12 supplies a negative voltage $V_{DAT}$ to the source of the selection TFT 15. As a result, the display cells CL are selected in the order of lines, and the selection TFT 15 of the selected display cell CL turns on so that the negative voltage $V_{DAT}$ is created on the capacitor $C_S$. Thus, the driving TFT 16 turns on and therefore has a conducting channel between the source and the drain thereof. On the other hand, the current supply circuit 13 switches the supply voltage $V_S$ from the high level $L_H$ to the low level $L_L$, and continuously supplies the supply voltage $V_S$ at low level $L_L$ to the source of the driving TFT 16 through the power supply line $K_P$. Consequently, the OLED 30 is applied with the reverse bias $L_{RV}$ through the source and drain of the driving TFT 16. In this way, the characteristics of the OLED 30 that has been degraded by the application of the forward bias are recovered by the application of the reverse bias.

It is known that when the OLED 30 is continuously driven at a constant voltage, the luminance of light emitted by the OLED 30 lowers as the driving time passes, resulting in degradation of the element performance. As described above, by temporarily stop applying the forward bias to the OLED 30 for a certain period as described in the above embodiment, the element performance can be recovered. By applying a reverse bias to the OLED 30 during the period of temporarily stopping applying the forward bias, the recovery of the element performance can be further improved.

Subsequently, in a second correction period for TFT characteristic, the second driving circuit 11 sequentially supplies negative selection pulses $MP_1, \ldots, MP_N$ to the scanning lines $S_1, \ldots, S_N$, respectively, while the first driving circuit 12 supplies a voltage $V_{DAT}$ having a positive level $L_C$ to the source of the selection TFT 15. As a result, the display cells CL are selected in the order of lines, and the selection TFT 15 of the selected display cell CL turns on to apply a reverse bias to the gate of the driving TFT 16 through the source and drain of the selection TFT 15. On the other hand, the current supply circuit 13 switches the supply voltage $V_S$ from the low level $L_L$ to the high level $L_H$, and supplies the supply voltage $V_S$ at high level $L_H$ to the source of the driving TFT 16 and to the capacitor $C_S$ through the power supply line $K_P$ during the second correction period for TFT characteristic.

In this way, since the reverse bias is applied to the gate of the driving TFT 16 in the second correction period for TFT characteristic, the characteristic of the driving TFT 16 is corrected for the threshold volt shift which has occurred during the emission period of the OLED 30.

In the driving method described above, the correction period for EL characteristic is followed by the second correction period for TFT characteristic, but the correction period for EL characteristic and the second correction period for TFT characteristic may be reversed in order.

The amounts of correction for the threshold voltage shifts of the selection TFT 15 and driving TFT 16 depend on the amplitude and pulse width (i.e., applied time) of the reverse biases applied to the selection TFT 15 and driving TFT 16, respectively. For this reason, the relationship between the threshold voltage shift and the amplitude of the reverse bias, and the relationship between the threshold voltage shift and the applied time of the reverse bias have been previously set in the signal control unit 20. Specifically, the signal control unit 20 stores a look-up table 20*t*, which shows these relationships, in an internal memory. The signal control unit 20 generates a control signal C1 for specifying the amplitude and pulse width of the correction pulses $CP_1, \ldots, CP_N$ while referencing the look-up table 20*t*, and in the second correction period for TFT characteristic, generates a control signal C2 for specifying the pulse width and level $L_C$ of the voltage $V_{DAT}$ applied to the gate of the driving TFT 16.

As described above, the display apparatus 1 can correct the threshold voltage shifts of the selection TFT 15 and driving TFT 16 every frame display period or every field display period, thus making it possible to avoid variations in the luminance of light emitted by the OLEDs and inoperative TFTs and to save the power consumption.

In this embodiment, the TFTs 15, 16 are applied with reverse biases, respectively, every frame display period or every field display period, but the present invention is not limited thereto. The TFTs 15, 16 may be applied with the reverse biases every predetermined number of frames or every predetermined number of fields.

The embodiment as described above employs, as a preferred configuration, a configuration having the first driving circuit 12 that supplies the reverse bias voltage $V_{DAT}$ to be applied to the gate of the driving TFT 16 through the data line $D_Q$ in the second correction period for TFT characteristic. In stead of this configuration, the present invention may employ a configuration having a group of power supply electrodes formed to transmit the reverse bias voltages in order to supply the reverse bias voltages to the gate of the driving TFTs 16 through the power supply electrodes.

Further, it is also possible to employ a configuration having a TFT formed to apply the reverse bias in each display cell CL; and a selection electrode formed to transmit a selection signal to be supplied to the gate of the formed TFT from the second driving circuit 11, where the formed TFT has a source connected to the power supply electrode and a drain connected to the gate of the driving TFT 16. This configuration can supply a voltage to the selection electrode to turn on the formed TFT by applying the voltage to the gate of the formed TFT in the second correction period for TFT characteristic, while applying the reverse bias voltage from the power supply electrode to the gate of the driving TFT 16 through the source and drain of the formed TFT.

Figure 8:
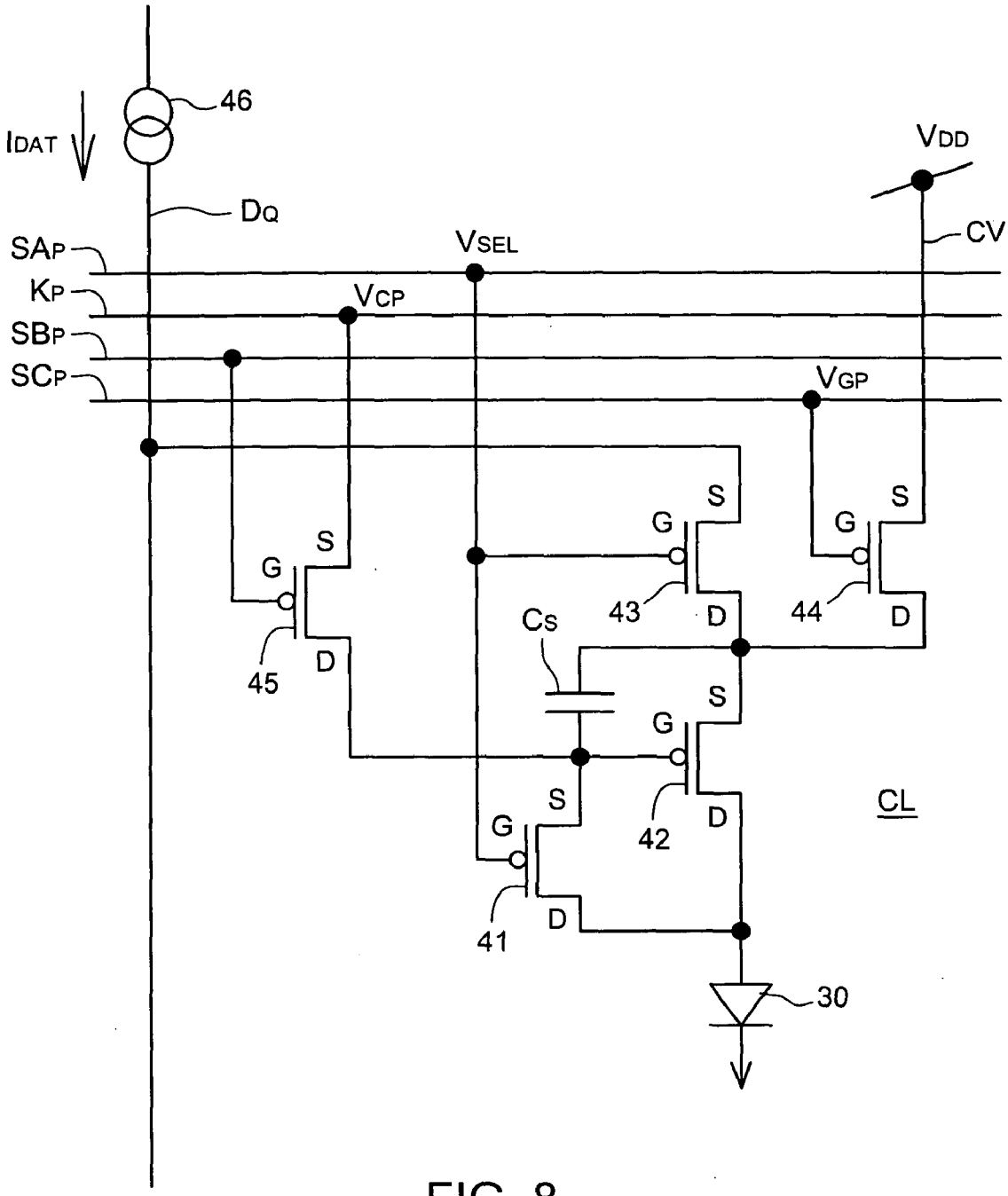
FIG. 8 depicts a schematic diagram showing another example of the equivalent circuit of the display cell.

The circuit of the display cell CL is not limited to the equivalent circuit shown in FIG. 6. The driving method such as this embodiment can also be applied to a circuit which can correct a threshold voltage shift of a TFT. FIG. 8 depicts a schematic diagram showing another example of the equivalent circuit of the display cell CL. Referring to FIG. 8, this display cell CL includes five p-channel TFTs 41, 42, 43, 44, 45, a capacitor $C_S$, and an OLED 30. Among these TFTs 41-45, the TFTs 41, 43 are selection transistors, and the TFTs 42, 44 are driving TFTs. The TFT 45 is a selection TFT for applying a reverse bias to the driving transistor 42.

A first scanning line (selection electrode) $SA_P$ (P is one of 1 to N) is connected to a gate (control terminal) of each selection TFT 41, 43. A second scanning line (selection electrode) $SB_P$ is connected to a gate (control terminal) of the reverse bias applying TFT 45. A third scanning line (selection electrode) $SC_P$ is connected to a gate (control terminal) of the driving TFT 44. These first to third scanning lines $SA_P$, $SB_P$, $SC_P$ are bundled into a scanning line $S_P$ (shown in FIG. 4). The data line $D_Q$ (Q is one of 1 to M) is connected to a source (controlled terminal) of the selection TFT 43, and the power supply line $K_P$ is connected to a source (controlled terminal) of the selection TFT 45 for applying a reverse bias. The data line $D_Q$ is connected to a current source 46 that generates a data current $I_{DAT}$. The supply voltage $V_{DD}$ is supplied from an external power-supply source outside the display unit 14. A power supply line CV for transmitting the supply voltage $V_{DD}$ is connected to a source (controlled terminal) of the driving TFT 44.

The driving TFT 42 has a source (controlled terminal) connected to both a drain (controlled terminal) of the selection TFT 43 and a drain (controlled terminal) of the TFT 44. The driving TFT 42 has a gate (control terminal) connected to a drain (controlled terminal) of the selection TFT 45 for applying a reverse bias. The driving TFT 42 further has a drain (controlled terminal) connected to an anode of the OLED 30. The selection TFT 41 has a source (controlled terminal) connected to the gate (control terminal) of the driving TFT 42, and further has a drain (controlled terminal) connected to the drain (controlled terminal) of the driving TFT 42. The capacitor $C_S$ has one end connected to the source of the driving TFT 42, and the other end connected to the gate of the driving TFT 42. A common potential is applied to a cathode of the OLED 30.

A brief description will be given below of a driving method (current programming driving method) using the display cell CL which has the element driving circuit described above. The operation period of the circuit shown in FIG. 8 is comprised of a selection period, an EL emission period, and a correction period for TFT characteristic. In the selection period, the second driving circuit 11 applies a voltage having a positive polarity level through the scanning line $SB_P$ to the gate of the selection TFT 45 for applying the reverse bias, and thereby turns off the TFT 45 that does not conduct current between the source and drain of the TFT 45. The second driving circuit 11 applies a voltage $V_{GP}$ having a positive polarity level through the scanning line $SC_P$ to the gate of the TFT 44, and thereby turns off the TFT 44, while applying a voltage $V_{SEL}$ having a negative polarity level through the scanning line $SA_P$ to the gates of the selection TFTs 41, 43 and thereby turning on the selection TFTs 41, 43. As a result, the data current $I_{DAT}$ flows between the source and drain of the driving TFT 42 and into the OLED 30, and therefore a data voltage corresponding to the data current $I_{DAT}$ is created on the capacitor $C_S$.

In this selection period, the second driving circuit 11 can correct for a threshold voltage shift of the driving TFT 44 by applying a reverse bias to the gate of the driving TFT 44 through the scanning line $SC_P$.

In the next EL emission period, the second driving circuit 11 applies the voltage $V_{GP}$ having a negative polarity level to the gate of the driving TFT 44 through the scanning line $SC_P$ and thereby turns on the driving TFT 44, while applying the voltage $V_{SEL}$ having a positive polarity level to the gate of each selection TFT 41, 43 through the scanning line $SA_P$ and thereby turning off the selection TFTs 41, 43. Thus, the supply voltage $V_{DD}$ is applied to the source of the driving TFT 42 through the source and drain of the driving TFT 44, and the OLED 30 is applied with a forward bias through the source and drain of the driving TFT 42. The data voltage created on the capacitor $C_S$ is the gate voltage $V_{GS}$ applied to the driving TFT 42. As a result, the current equal to the data current $I_{DAT}$ flows into the OLED 30, causing the OLED 30 to emit light.

In this EL emission period, the second driving circuit 11 can correct respective threshold voltage shifts of the selection TFTs 41, 43 by applying a reverse bias to the gates of selection TFT 41, 43 through the scanning line $SA_P$.

Subsequently, in a correction period for TFT characteristic, the second driving circuit 11 applies a voltage having a negative polarity level through the scanning line $SB_P$ to the gate of the selection TFT 45 for applying a reverse bias, and thereby turns on the TFT 45. The second driving circuit 11 then applies the gate of the driving TFT 42 with a correction voltage (reverse bias) $VC_P$ supplied from the power supply line $K_P$ through the source and drain of the TFT 45. In this way, the characteristic of the driving TFT 42 can be corrected for a threshold voltage shift. During a period in which the reverse bias is applied to the gate of the driving TFT 42, it is preferable that the driving TFT 44 is turned on to apply the supply voltage $V_{DD}$ to the capacitor $C_S$ in order to stabilize the gate-to-source voltage of the driving TFT 42 and to appropriately recover the element characteristics.

As described above, the current programming driving method using the element driving circuit of FIG. 8 corrects the threshold voltage shifts of the selection TFTs 41, 43, selection TFT 45 for applying a reverse bias, and driving TFTs 42, 44 every frame display period or every field display period, thus making it possible to limit these threshold voltage shifts within a minimum range. It is therefore possible to avoid variations in the luminance of light emitted by the OLEDs and inoperative TFTs, and to save the power consumption.

In this embodiment, the reverse bias is applied to each of the TFTs 41-45 every frame display period or every field display period, but the present invention is not limited thereto. The reverse bias may be applied to each of the TFTs 41-45 every predetermined number of frames or every predetermined number of fields.

Figure 9:
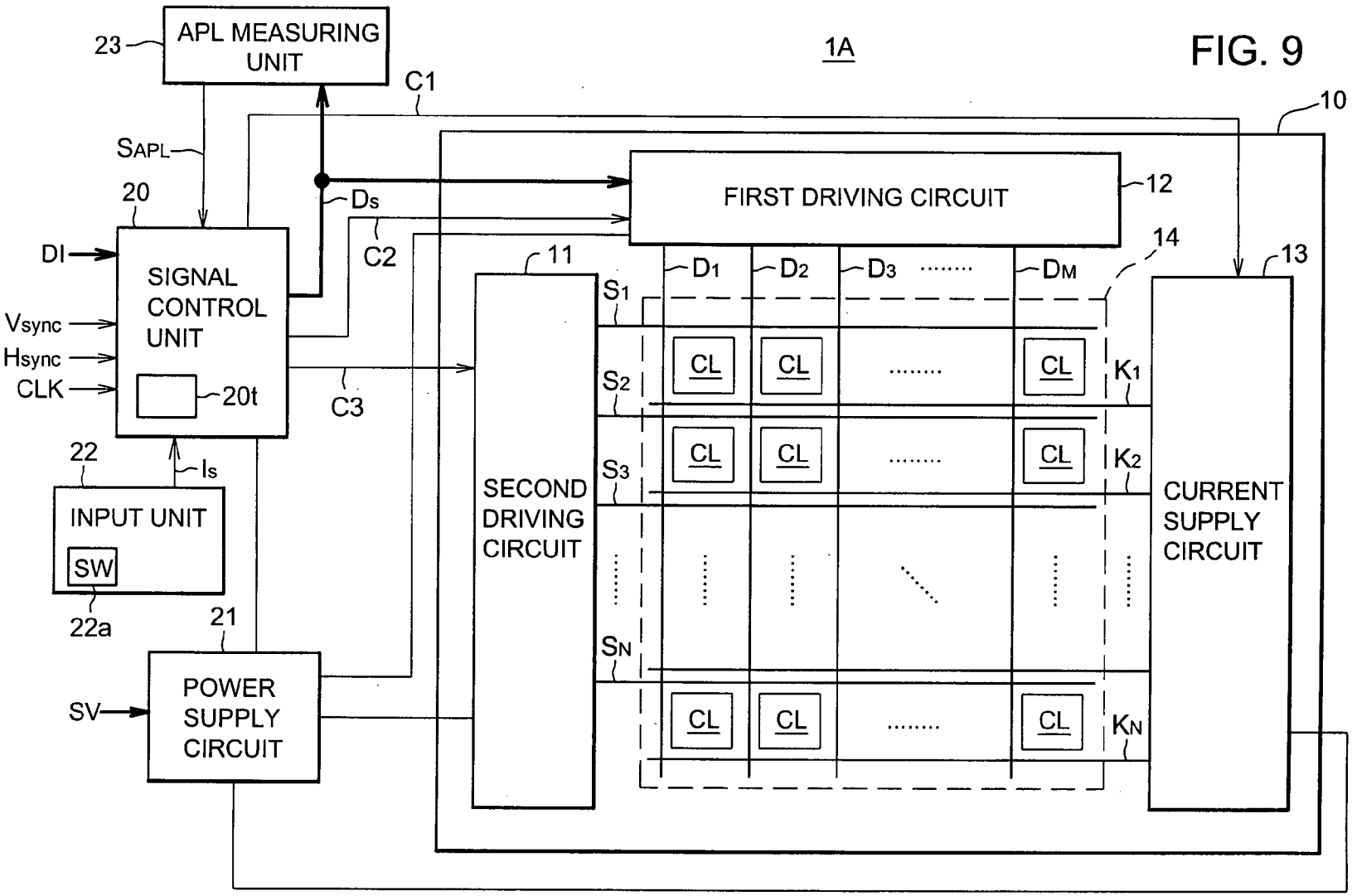
FIG. 9 depicts a block diagram schematically showing a display apparatus of another embodiment according to the present invention.

Next, a display apparatus 1A of another embodiment according to the present invention will be described. FIG. 9 depicts a block diagram schematically showing a display apparatus of another embodiment according to the present invention. Elements indicated by the same reference numerals in FIGS. 9 and 4 have the same functions, and the detailed description of these elements will not be given. The display apparatus 1A is the same as the display apparatus 1 (FIG. 4) in configuration except an input unit 22 and an APL measuring unit 23.

The input unit 22 comprises input keys (not shown) and an input switch 22*a*, thus allowing the user (including a manufacturer and a product seller) to set the values of the pulse width (i.e., applying time) and amplitude of the reverse bias to be applied for correcting a threshold voltage shift through manual operation on the input unit 22. The signal control unit 20 reads set values Is from the input unit 22 upon activation of a system, and determines data to be stored in the look-up table 20*t* based on these set values Is. The user can set the values of the pulse width and amplitude of the reverse bias in accordance with the type of equipment which incorporates the display apparatus 1A through manual operation on the input unit 22, for example, at the time of shipment. For example, a portable telephone differs from a television set for displaying video images of terrestrial broadcasting video images in the contents of displayed images, and an average TFT driving time is also different, so that appropriate values can be set in accordance with the type of equipment which incorporates the display apparatus 1A, or depending on a particular application of the display apparatus 1A.

The input unit 22 also has an input switch 22*a* for switching a set value for at least one of the pulse width and amplitude of the reverse bias in response to manual input of the user. The user can select appropriate set values in accordance with the application of the display apparatus 1A from among previously determined values by manipulating the input switch 22*a*.

The APL measuring unit 23 measures an average peak level (APL) of an image data signal $D_S$, for example, over several tens to several hundreds of frames in real time, and supplies the signal control unit 20 with a signal $S_{APL}$ indicative of the result of the measurement. The signal control unit 20 can apply the reverse bias to the driving TFT or selection TFT in accordance with the result of the measurement. For example, when the average peak level exceeds a predetermined level, the signal control unit 20 does not generate the reverse bias for the threshold voltage shift correction in the expectation that the threshold voltage shift of the TFT is within a small range. On the other hand, when the average peak level is equal to or lower than the predetermined level, the signal control unit 20 can generate the reverse bias for the threshold voltage shift correction in the expectation that the TFT suffers from a large threshold voltage shift.

Alternatively, the signal control unit 20 can increase the pulse width or amplitude of the reverse bias for the threshold voltage shift correction as the average peak level is higher, and can reduce the pulse width or amplitude of the reverse bias for the threshold voltage shift correction as the average peak level is lower. In this way, by monitoring the average luminance level in real time to determine the magnitude of the threshold voltage shift of the TFT, it is possible to adjust the pulse width or amplitude of the reverse bias to an appropriate value. Accordingly, the threshold voltage shift of the TFT can be limited within a minimum range.

It is understood that the foregoing description and accompanying drawings set forth the preferred embodiments of the invention at the present time. Various modifications, additions and alternatives will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

This application is based on Japanese Patent Application No. 2005-23547 which is hereby incorporated by reference.

What is claimed is:

1. A display apparatus comprising row electrodes, column electrodes intersecting said row electrodes, a driving unit for supplying a scanning signal to said row electrodes and supplying data signals to said column electrodes, self-emissive elements respectively formed in regions corresponding to respective intersections of said row electrodes with said column electrodes, and element driving circuits respectively formed in regions corresponding to the respective intersections for driving said self-emissive elements in accordance with the scanning signal and the data signals, each of said element driving circuits including:

at least one selection transistor having a control terminal connected to said row electrode and having a first and a second controlled terminal, said at least one selection transistor having a conducting channel between said first and second controlled terminals in response to a forward bias applied to said control terminal on receiving the scanning signal;

a capacitor for accumulating charges which creates a voltage corresponding to the data signal supplied from said driving unit through said first and second controlled terminals of said selection transistor in a period in which said selection transistor has a conducting channel between said first and second controlled terminals; and a driving transistor having a control terminal connected to one end of said capacitor, and a first and a second controlled terminal, one of said first and second controlled terminals being connected to said self-emissive element, and said driving transistor supplying said self-emissive element with an amount of driving current depending on a forward bias which is applied to said control terminal in response to the voltage created on said capacitor, wherein said driving unit applies a reverse bias voltage to the control terminal of said driving transistor in a non-emission period in which the driving current is not applied to said self-emissive element, while changing at least one of a pulse width and an amplitude of said reverse bias voltage in accordance with an average peak level of an image signal.

2. A display apparatus according to claim 1, wherein said driving transistor is an organic transistor including an active layer made of an organic semiconductor.

3. A display apparatus according to claim 1, wherein said driving unit applies the reverse bias voltage to the control terminal of said driving transistor every frame display period or every field display period.

4. A display apparatus according to claim 1, further comprising power supply electrodes for transmitting the reverse bias voltage to said element driving circuits, wherein:

said row electrodes include selection electrodes for transmitting selection signals supplied from said driving unit;

each of said element driving circuits includes a transistor for applying the reverse bias voltage having a control terminal connected to the selection electrode and having a first and a second controlled terminal, wherein one of said first and second controlled terminals of said transistor for applying the reverse bias voltage is connected to said power supply electrode, and the other one of said first and second controlled terminals of said transistor for applying the reverse bias voltage is connected to the control terminal of said driving transistor; and said driving unit applies the control terminal of said transistor for applying the reverse bias voltage with a voltage through the selection electrode so as to form a conducting channel between the first and second controlled terminals of said transistor during the non-emission period.

5. A display apparatus according to claim 1, further comprising a luminance level measuring unit for measuring the average peak level of the image signal, wherein said driving unit applies the reverse bias voltage to the control terminal of said driving transistor in accordance with the result of the measurement of the average peak level.

6. A display apparatus according to claim 1, further comprising an input unit for setting a value of at least one of a pulse width and an amplitude of the reverse bias voltage to be applied to the control terminal of said driving transistor.

7. A display apparatus according to claim 6, wherein said input unit includes a switch for switching a set value of at least one of the pulse width and the amplitude of the reverse bias voltage in response to a manual input.

8. A display apparatus according to claim 1, wherein said selection transistor is an organic transistor including an active layer made of an organic semiconductor, wherein said driving unit applies a reverse bias voltage to the control terminal of said selection transistor in an emission period in which said self-emissive element is supplied with the driving current.

9. A display apparatus according to claim 1, wherein said driving unit includes a circuit for applying a reverse bias voltage to said self-emissive element.

10. A display apparatus according to claim 1, wherein said driving unit includes:

a first driving circuit for accumulating charges which creates a data voltage depending on the data current on said capacitor by supplying the data current from the column electrode to said capacitor through the first and second controlled terminals of said selection transistor in a period in which said selection transistor has a conducting channel between the first and second controlled terminals;

a second driving circuit for, after the creation of the data voltage on said capacitor, applying the control terminal of said selection transistor with a voltage through the row electrode so as to cause said selection transistor to have no conducting channel between the first and second controlled terminals; and a power supply for supplying a supply voltage to said driving transistor after said selection transistor has no conducting channel between the first and second controlled terminals.

11. A display apparatus according to claim 10, further comprising a power supply line for transmitting the power supply voltage to said element driving circuit, wherein:

said row electrodes include selection electrodes for transmitting a selection signal supplied from said second driving circuit;

each of said element driving circuit includes a voltage supply transistor having a control terminal connected to said selection electrode and having a first and a second controlled terminal, wherein one of the first and second controlled terminals of said voltage supply transistor is connected to one of the first and second controlled terminal of said driving transistor, and the other one of the first and second controlled terminals of said voltage supply transistor is connected to the power supply line; and said second driving circuit applies the control terminal of said voltage supply transistor with a voltage through the selection electrode so as to form a conducting channel between the first and second controlled terminals of said voltage supply transistor after disappearance of the conducting channel between the first and second controlled terminals of said selection transistor.

12. A display apparatus according to claim 1, wherein said self-emissive element is an organic EL (electroLuminescent) element.

13. A driving method for a display apparatus including row electrodes, column electrodes intersecting said row electrodes, a driving unit for supplying a scanning signal to said row electrodes and supplying data signals to said column electrodes, self-emissive elements respectively formed in regions corresponding to intersections of said row electrodes with said column electrodes, and element driving circuits formed in regions corresponding to the respective intersections for driving said self-emissive elements in accordance with the scanning signal and the data signals, wherein each of said element driving circuits includes: at least one selection transistor having a control terminal connected to said row electrode, and a first and a second controlled terminal; a capacitor; and a driving transistor having a control terminal connected to one end of said capacitor and having a first and a second controlled terminal, one of said first and second controlled terminals being connected to said self-emissive element, said driving method comprising the steps of:

(a) supplying said selection transistor with a scanning signal to apply a forward bias to the control terminal of said selection transistor to form a conducting channel between said first and second controlled terminals of said selection transistor;

(b) supplying a data signal to said capacitor through the first and second controlled terminals of said selection transistor in a period in which said selection transistor has a conducting channel between the first and second controlled terminals, to accumulate charges which creates a voltage corresponding to the data signal on said capacitor;

(c) supplying said self-emissive element with an amount of driving current depending on a forward bias which is applied to said control terminal of said driving transistor in response to the voltage created on said capacitor; and (d) applying a reverse bias voltage to the control terminal of said selection transistor in an emission period in which said self-emissive element is supplied with the driving current, said reverse bias voltage having a polarity reverse to a polarity of the scanning signal.

14. A display apparatus comprising row electrodes, column electrodes intersecting said row electrodes, a driving unit for supplying a scanning signal to said row electrodes and supplying data signals to said column electrodes, self-emissive elements respectively formed in regions corresponding to respective intersections of said row electrodes with said column electrodes, and element driving circuits formed in regions corresponding to the respective intersections for driving said self-emissive elements in accordance with the scanning signal and the data signals, each of said element driving circuits including:

at least one selection transistor having a control terminal connected to said row electrode and having a first and a second controlled terminal, said at least one selection transistor having a conducting channel between said first and second controlled terminals in response to a forward bias applied to said control terminal on receiving the scanning signal;

a capacitor for accumulating charges which creates a voltage corresponding to the data signal supplied from said driving unit through said first and second controlled terminals of said selection transistor in a period in which said selection transistor has a conducting channel between said first and second controlled terminals; and a driving transistor having a control terminal connected to one end of said capacitor, and a first and a second controlled terminal, one of said first and second controlled terminals being connected to said self-emissive element, and said driving transistor supplying said self-emissive element with an amount of driving current depending on a forward bias which is applied to said control terminal in response to the voltage created on said capacitor, wherein said driving unit applies a reverse bias voltage to the control terminal of said selection transistor in an emission period in which the driving current is applied to said self-emissive element, said reverse bias voltage having a polarity reverse to a polarity of the scanning signal.

15. A display apparatus according to claim 14, wherein said selection transistor is an organic transistor including an active layer made of an organic semiconductor.

16. A display apparatus according to claim 14, wherein said driving unit applies the reverse bias voltage to the control terminal of said selection transistor every frame display period or every field display period.

17. A display apparatus according to claim 14, further comprising a luminance level measuring unit for measuring an average peak level of an image signal, wherein said driving unit changes at least one of a pulse width and an amplitude of the reverse bias voltage to be applied to the control terminal of said selection transistor in accordance with the average peak level.

18. A display apparatus according to claim 14, further comprising a luminance level measuring unit for measuring an average peak level of an image signal, wherein said driving unit applies the reverse bias voltage to the control terminal of said selection transistor in accordance with the result of the measurement of the average peak level.

19. A display apparatus according to claim 14, further comprising an input unit for setting a value of at least one of a pulse width and an amplitude of the reverse bias voltage to be applied to the control terminal of said selection transistor.

20. A display apparatus according to claim 19, wherein said input unit includes a switch for switching a set value of at least one of the pulse width and the amplitude of the reverse bias voltage in response to a manual input.

21. A display apparatus according to claim 14, wherein said driving transistor is an organic transistor including an active layer made of an organic semiconductor, and said driving unit applies a reverse bias voltage to the control terminal of said driving transistor in a non-emission period in which the self-emissive element is not supplied with the driving current.

22. A display apparatus according to claim 14, wherein said driving unit includes a circuit for applying a reverse bias voltage to said self-emissive element.

23. A display apparatus according to claim 14, wherein said driving unit includes:

a first driving circuit for accumulating charges which creates a data voltage depending on the data current on said capacitor by supplying the data current from the column electrode to said capacitor through the first and second controlled terminals of said selection transistor in a period in which said selection transistor has a conducting channel between the first and second controlled terminals;

a second driving circuit for, after the creation of the data voltage on said capacitor, applying the control terminal of said selection transistor with a voltage through the row electrode so as to cause said selection transistor to have no conducting channel between the first and second controlled terminals; and a power supply for supplying a supply voltage to said driving transistor after said selection transistor has no conducting channel between the first and second controlled terminals.

24. A display apparatus according to claim 23, further comprising a power supply line for transmitting the power supply voltage to said element driving circuit, wherein:

said row electrodes include selection electrodes for transmitting a selection signal supplied from said second driving circuit;

each of said element driving circuit includes a voltage supply transistor having a control terminal connected to said selection electrode and having a first and a second controlled terminal, wherein one of the first and second controlled terminals of said voltage supply transistor is connected to one of the first and second controlled terminal of said driving transistor, and the other one of the first and second controlled terminals of said voltage supply transistor is connected to the power supply line; and said second driving circuit applies the control terminal of said voltage supply transistor with a voltage through the selection electrode so as to form a conducting channel between the first and second controlled terminals of said voltage supply transistor after disappearance of the conducting channel between the first and second controlled terminals of said selection transistor.

25. A display apparatus according to claim 14, wherein said self-emissive element is an organic EL (electroLuminescent) element.

* * * * *